United States Patent [19]

Bogner

[11] Patent Number: 4,700,869

[45] Date of Patent: Oct. 20, 1987

[54] SINGLE ITEM VENDING MACHINE

[76] Inventor: Erwin Bogner, 12 Tompkins Ave., Babylon Village, N.Y. 11707

[21] Appl. No.: 784,613

[22] Filed: Oct. 4, 1985

[51] Int. Cl.[4] ..... G07F 11/16

[52] U.S. Cl. ..... 221/229; 221/241; 221/249

[58] Field of Search ..... 221/249, 241, 242, 228, 221/229; 414/131

[56] References Cited

U.S. PATENT DOCUMENTS

| | | | |
|---|---|---|---|
| 1,419,075 | 6/1922 | Prosser | 221/241 X |
| 1,434,061 | 10/1922 | Lewis | 221/241 |
| 1,677,938 | 7/1928 | Van Sickle | 221/241 |
| 2,263,040 | 11/1941 | Kaltenbach | 221/213 |
| 3,298,570 | 1/1967 | Skorey et al. | 221/242 |
| 4,331,261 | 5/1982 | Brown | 221/249 X |
| 4,501,379 | 2/1985 | Halone et al. | 221/241 X |

*Primary Examiner*—Robert J. Spar
*Assistant Examiner*—Jay I. Alexander
*Attorney, Agent, or Firm*—Davis Hoxie Faithfull & Hapgood

[57] ABSTRACT

A single item vending machine, particularly for vending only a single newspaper for each vend operation, is disclosed. The machine has a slot, which is adjustable in height, in the front of the frame of the machine through which the newspaper is vended. A door on the front of the machine prevents access to the slot unless the door is opened. The door cannot be opened unless the required coins are placed in a coin mechanism, thus releasing a door lock. Mounted inside the machine is a base plate. Mounted on top of the base plate are ball bearings. Resting on the ball bearings is a transfer plate which has a raised rear portion which is approximately ½ inch higher than a lower front portion of the transfer plate. When the machine is in the closed and locked position, the newspapers are stacked on the lower front portion of the transfer plate. The transfer plate, which is connected to the door by at least one hinge and lever arm, slides forward when the door is opened by the purchaser. As the transfer plate slides forward, the raised rear portion of the transfer plate pushes the bottom newspaper in the stack out of the slot in the front of the machine. The purchaser may then remove that newspaper, but cannot without a great deal of difficulty remove any of the other newspapers from inside the machine. When the purchaser lets go of the door, the door closes and the machine is ready for the next vend operation.

23 Claims, 11 Drawing Figures

SINGLE ITEM VENDING MACHINE

FIELD OF THE INVENTION

This invention relates to a vending machine designed to permit vending of a single item (such as a single newspaper) while making it very difficult for a purchaser to take more than one item from the machine for each vend operation.

BACKGROUND OF THE INVENTION

In newspaper vending, the theft of newspapers from newspaper vending machines has been a long-standing problem.

A person purchasing a newspaper from conventional newspaper vending machines can, upon depositing the required coins in the machine, take from the machine multiple copies of the newspaper. In fact, conventional newspaper vending machines do not have any way of preventing the wholesale theft of all of the newspapers from the machine once the machine is opened by the purchaser. These conventional newspaper vending machines are known as "honor boxes" because the vendor must rely on the honesty of the purchaser to safeguard against the theft of newspapers.

The loss to newspaper vendors because of this problem has been and remains significant, and the industry has for many years had a need for an effective single vend machine in order to make it very difficult or impossible for the purchaser to take more than one newspaper from the vending machine for each vend operation.

To date, the prior attempts at making a reliable single newspaper vending machine have not been completely effective. For example, in certain prior single vend machines a complicated belt and pulley arrangement is used, and when this arrangement jams, the purchaser is unable to remove the newspaper from the machine. The machine cannot operate until the jam is cleared by the vendor, resulting in a loss of business to the vendor.

SUMMARY OF THE INVENTION

The present invention is for a single item vending machine, particularly for a machine which will vend a single newspaper, whereby a person is able to obtain only one newspaper from the machine during each vend operation. The machine of the present invention has a slot in a front wall of the frame of the machine from which the newspaper is vended. The machine also has a door which covers the slot. The door cannot be opened to give access to the slot unless the purchaser places the appropriate coins in a coin mechanism.

The machine of the present invention also has a support means which is mounted within the frame. In one embodiment the support means is a base plate mounted within the frame of the machine with slide means, such as ball bearings, mounted on top of the base plate. Resting on the slide means is a transfer plate which has a raised rear portion which is at a higher level than a lower front portion of the transfer plate.

The transfer plate is connected to the door in a manner such that when the purchaser pulls the door out and down, the transfer plate slides forward on the slide means and the raised rear portion of the transfer plate pushes a single newspaper out of the slot. The purchaser may then take the newspaper from the machine. The height of the slot is adjustable for newspapers of different thicknesses.

BRIEF DESCRIPTION OF DRAWINGS

For a better understanding of the invention, reference should be made to the accompanying drawings in which.

DETAILED DESCRIPTION OF THE INVENTION

Figure 1:
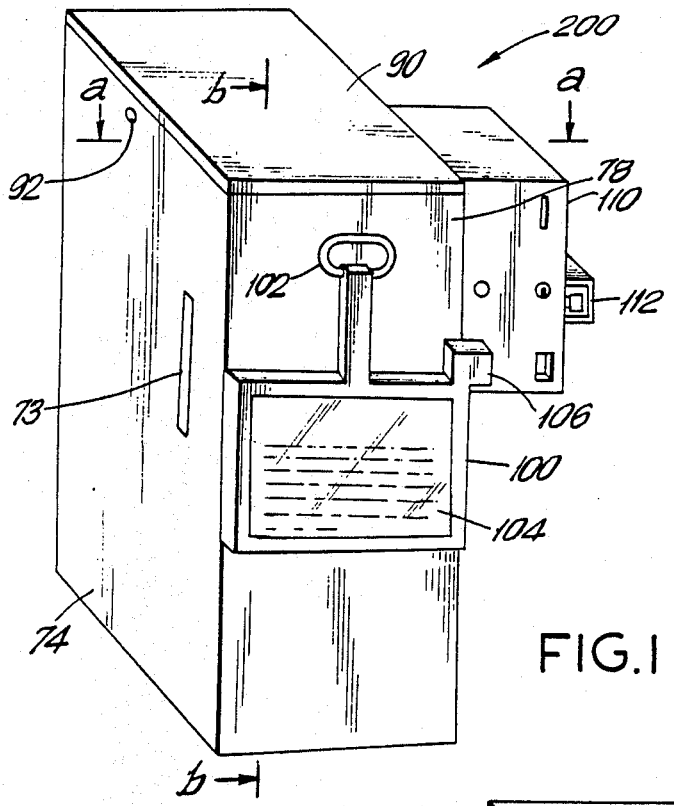
FIG. 1 is perspective view of an embodiment of a vending machine of the present invention in the closed and locked position.
Figure 2:
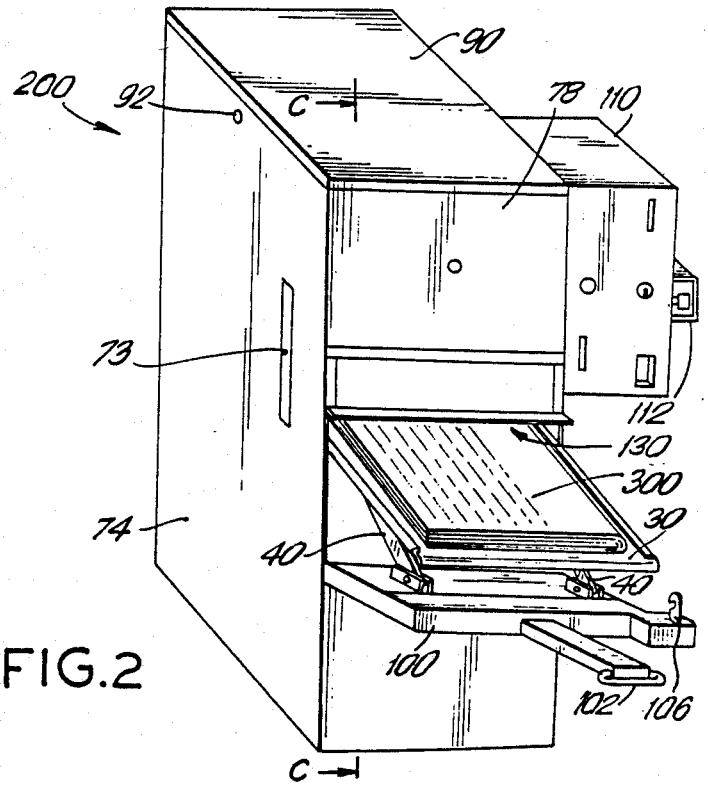
FIG. 2 is a perspective view of an embodiment of a vending machine of the present invention in the open vend position.

An embodiment of a vending machine 200 of the present invention is shown generally in FIGS. 1 and 2.

In the present embodiment, the machine 200 is of a rectangular shape and is constructed of cold rolled steel or hot rolled steel. Mounted on the outside of a front wall 78 of the machine 200 is an access means by which a purchaser can gain access to a newspaper. In the present embodiment, the access means is a door 100 and a handle 102 as shown in FIG. 1.

The machine 200 also includes activation means, whereby the access means can be released by the purchaser for gaining access to a newspaper. In the present embodiment, the activation means comprises a coin mechanism 110 which is attached to the machine 200 as shown in FIGS. 1 and 2. The coin mechanism 110 is of conventional design, and, for example, may be a mechanism manufactured by the Kasper Corporation. The coin mechanism 110 has a coin mechanism lock 112 attached to it in order to secure the coin mechanism 110 against theft or tampering. The door 100 is secured to the machine 200 by a door lock 106 such that the door 100 may not be opened unless the required coins are placed in the coin mechanism 110.

The front of the door 100 has a plexiglass window 104 for showing a sample of the newspaper available for vending from the machine 200. Further, an opening 73 is cut in a side 74 of the machine 200 so that the potential purchaser can check that newspapers are still available for vending from the machine 200.

In order to obtain a newspaper from the machine 200, the purchaser first deposits the required coins in coin mechanism 110. This releases door lock 106 and permits the purchaser to open the door 100 using the handle 102. When the purchaser pulls the handle 102 out and down, as shown in FIG. 2, a transfer plate 30 slides out of the front of the machine 200 through a slot 130. A newspaper 300, which is on top of the transfer plate 30, is then available to the purchaser as shown in FIG. 2.

As described in detail below, the purchaser has a great deal of difficulty reaching inside the machine 200 and taking additional newspapers when the door 100 is open. A person cannot reach into the machine 200 through slot 130 when the door 100 is closed because the door 100, when closed, blocks access to the slot 130.

Further details of the structure and operation of the machine 200 are described below and shown in FIGS. 3, 4, 4A, 5, 5A, 6, 7, 8 and 9. As shown in FIGS. 4, 4A, 5 and 5A, inside the machine 200 is mounted a base plate 10. The base plate 10 in the present embodiment is also made of steel, and is placed at such a height in the machine 200 as to permit vending of a single newspaper at a distance from the ground convenient to the purchaser.

Figure 3:
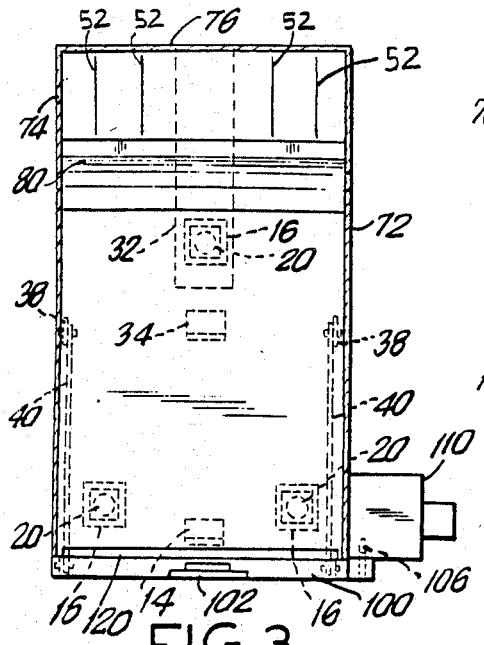
FIG. 3 is a top view of the vending machine along section line a—a of FIG. 1 without any newspapers in the machine.
Figure 8:
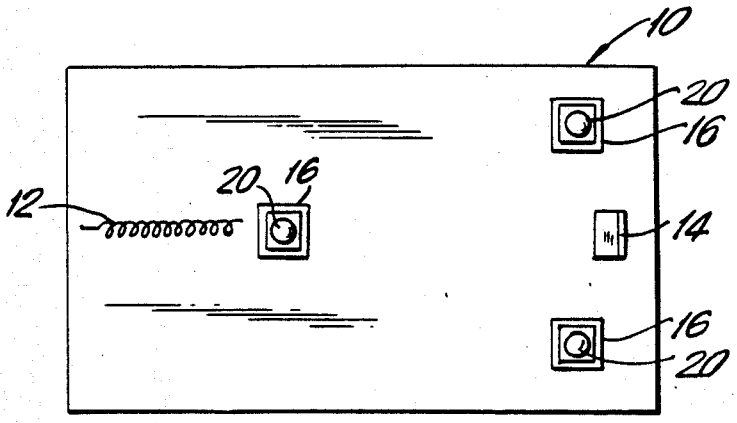
FIG. 8 is a detail drawing in isolation of the top of a base plate suitable for use in the vending machine of the present invention.
Figure 9:
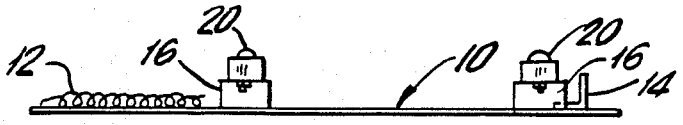
FIG. 9 is a side elevational view of the base plate of FIG. 8.

Three brackets 16 are mounted on base plate 10, as shown in FIGS. 3 and 8. Attached to the brackets 16 are three nylon ball bearings 20, two toward the front of the machine 200 and one toward the rear, also as shown in FIGS. 3 and 8. The nylon ball bearings 20 are of conventional construction, and may suitably be nylon bearings manufactured by the Interoll Corporation. Each nylon ball bearing 20 is bolted to one of the three brackets 16 and the brackets 16 are spot welded to the base plate 10.

Also attached to the base plate 10 is one end of a spring 12, as shown in FIGS. 4, 5, 8 and 9. Also attached to the base plate 10 is a base plate stop 14, as most easily seen in FIGS. 8 and 9. This stop 14 is spot welded to the base plate 10.

Figure 4:
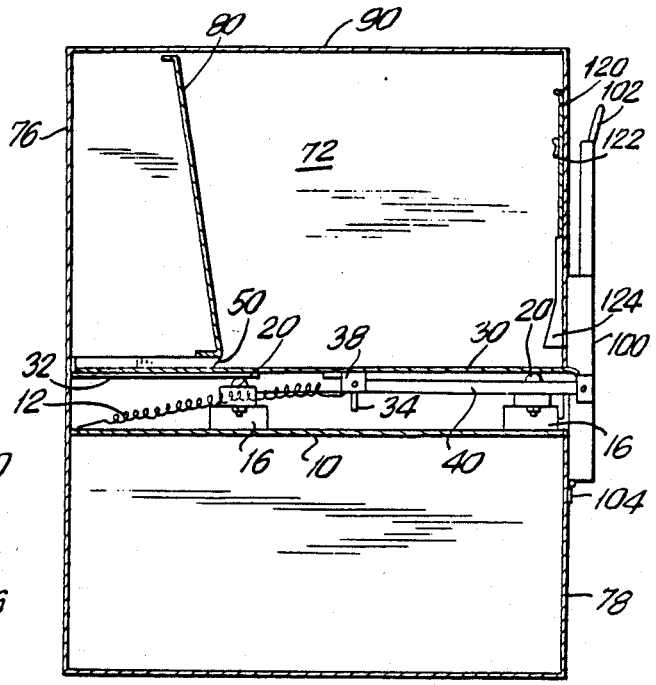
FIG. 4 is a side view of the vending machine along section line b—b of FIG. 1 without any newspapers in the machine.
Figure 5:
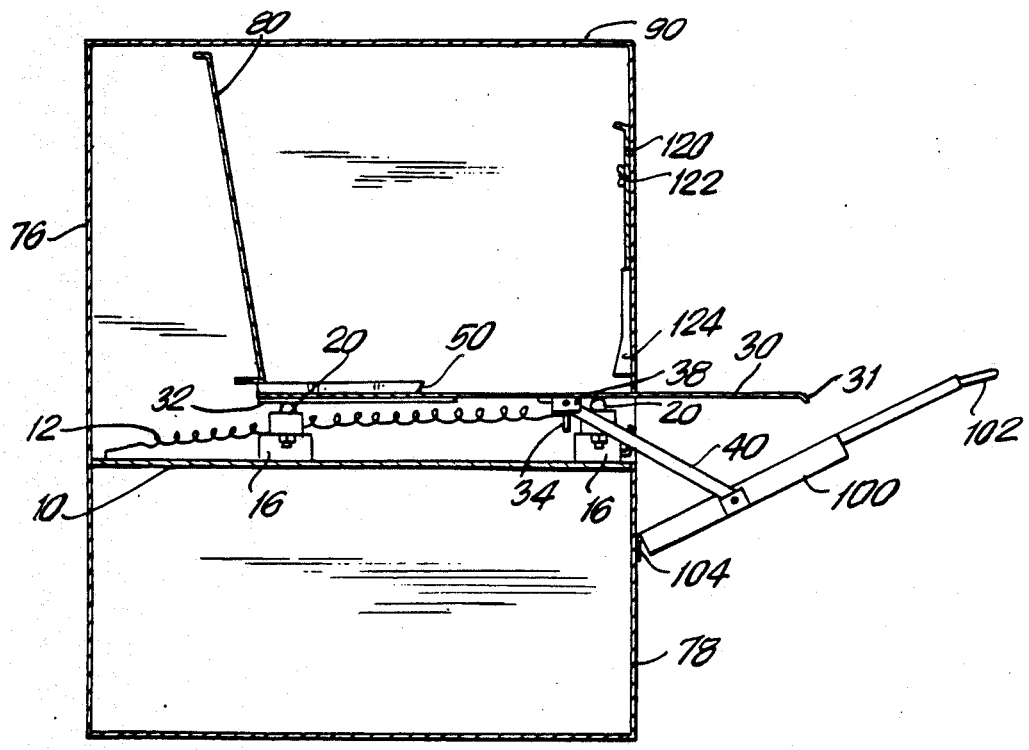
FIG. 5 is a side view of the vending machine along section line c—c of FIG. 2 without any newspapers in the machine.
Figure 6:
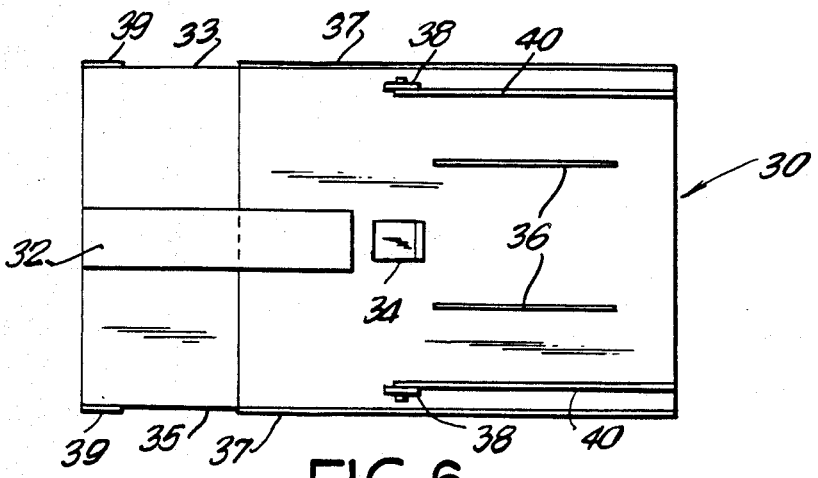
FIG. 6 is a detail drawing in isolation of the bottom of a transfer plate suitable for use in a vending machine of the present invention.

Resting on top of the ball bearings 20 is the transfer plate 30. The transfer plate 30 in the present embodiment is also made of steel. Attached to the underside of the transfer plate 30 (the side resting on the ball bearings 20) are a glide plate 32, a transfer plate stop 34, two metallic braces 36, and two hinges 38, as shown in FIG. 6. Connected to the hinges 38 are lever arms 40. The transfer plate stop 34 has a hole for attachment of one end of the spring 12. The other end of spring 12 is attached to base plate 10. The spring 12, with one end attached to the base plate 10 and the other end attached to the transfer plate stop 34, is shown in FIGS. 4 and 5.

Figure 7:
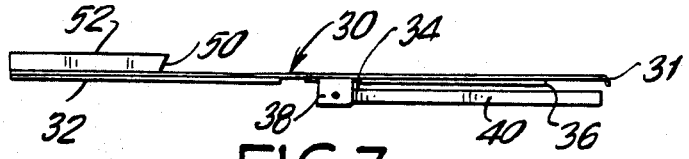
FIG. 7 is a side elevational view of the transfer plate of FIG. 6.

The transfer plate 30 is shown in detail in FIGS. 6 and 7. A lip 50 is integral to the transfer plate 30. The metal of the transfer plate 30 is bent in the manner shown in FIG. 7, thus creating the lip 50. The raised rear portion of the transfer plate 30, which is designated as lip 50, is, in the present embodiment, preferably approximately ½ inch higher than the lower front portion of the transfer plate 30. A height differential other than approximately ½ inch could be used in the machine of the present invention, depending upon the thickness of the item which is to be vended.

The glide plate 32 is attached to the underside of the transfer plate 30 in such a manner that the transfer plate 30 will stay horizontal as it slides in the machine 200 during the vend operation, as described below. The glide plate 32 insures that the transfer plate 30 remains horizontal because the glide plate 32 is at the same level as the front portion of the transfer plate 30, as readily seen in FIGS. 4, 5 and 7.

The top surface of the lip 50 has plastic strips 52 attached to it, as shown in FIG. 3. Newspapers may slide easily on these strips, as described below.

Figure 5A:
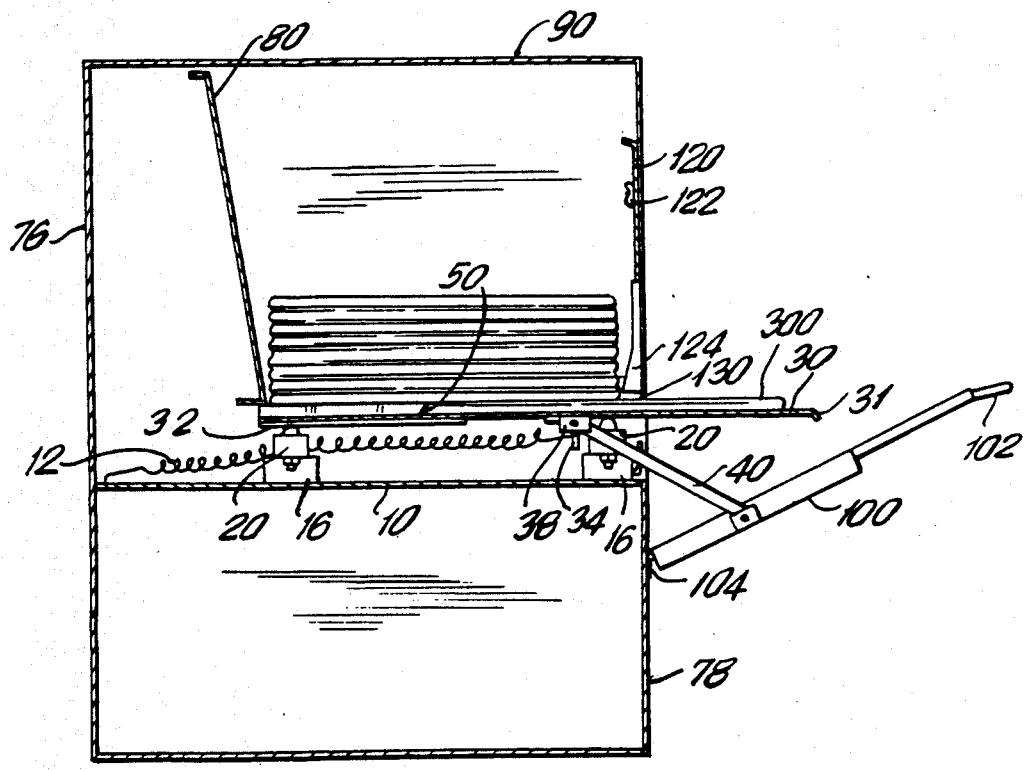
FIG. 5A is a side view of the vending machine along section line c—c of FIG. 2 with newspapers in the machine.

The front of the transfer plate 30 curves downwardly at surface curve 31, as shown in FIGS. 5, 5A and 7. This prevents the purchaser from injuring himself against the front edge of the transfer plate 30 when taking a newspaper from the machine. Portions of sides 33 and 35 of the transfer plate 30 have mylar strips 37 attached to them as shown in FIG. 6 in order to prevent the purchaser from injuring himself against sharp exposed portions of the sides 33 and 35 of the transfer plate 30 during the vend operation. These Mylar strips 37 also assist the sliding of the transfer plate 30 during the vend operation, and also assist in the prevention of rotational movement of the transfer plate 30. Also, a small amount of Mylar 39 on the sides 33 and 35 of the transfer plate 30, as shown in FIG. 6, assists in the sliding of the transfer plate 30 during the vending operation, and also aids in preventing rotational movement of the transfer plate 30.

The metallic braces 36 are connected to the underside of the transfer plate 30 as shown in FIG. 6 in order to reinforce the transfer plate 30 and to prevent the transfer plate 30 from bending. These braces 36 are not needed if a stiff steel is used for the transfer plate 30.

When the machine 200 is in the closed and locked position (FIGS. 1, 3, 4 and 4A), and the transfer plate 30 is resting on the two front ball bearings 20, the glide plate 32, which is resting on the rear ball bearing 20, extends from a back wall 76 of the machine 200 to preferably approximately two inches forward of the rear ball bearing 20. This insures that the glide plate 32 is in contact with the rear ball bearing 20 throughout the entire vend operation. When the machine 200 is in the closed and locked position, as shown in FIGS. 4 and 4A, the transfer plate 30, including the lip 50, extends from the back wall 76 of the machine 200 to a front wall 78 of the machine 200.

Mounted within the machine 200 is a back plate 80. The back plate 80 extends from just below a top cover 90 of the machine 200 down to just above the lip 50 of transfer plate 30, as shown in FIG. 4. The back plate 80 is riveted to side walls 72 and 74 of the machine 200. When the machine 200 is in the closed and locked position, the lip 50 of the transfer plate 30 is just behind the bottom front corner of back plate 80, as shown in FIG. 4.

Figure 4A:
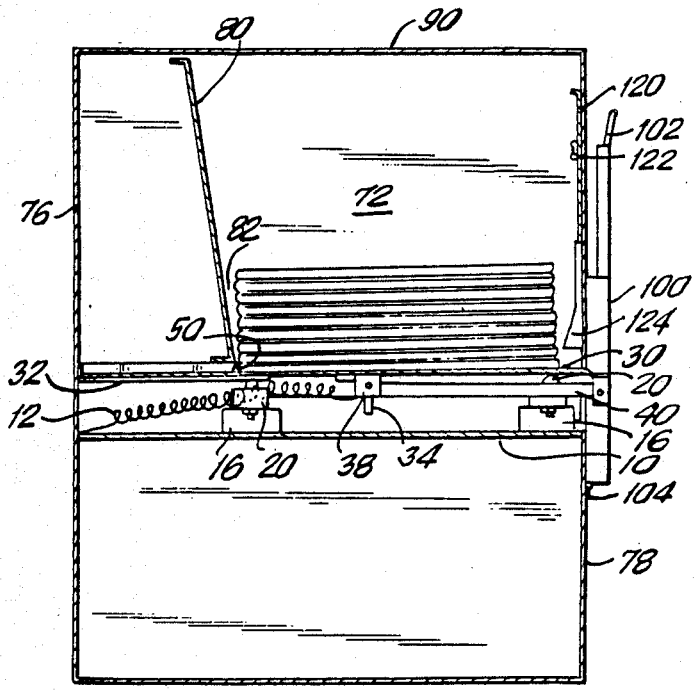
FIG. 4A is a side view of the vending machine along section line b—b of FIG. 1 with newspaper in the machine.

The top cover 90, back plate 80, transfer plate 30 and front wall 78 define an interior space within the machine 200 wherein the newspapers are stacked as shown in FIG. 4A.

Newspapers are loaded into the machine 200 by unlocking a top cover lock 92 and lifting the cover 90. The newspapers may then be placed inside the machine in a stack by the vendor, one on top of another as shown in FIG. 4A. In the present embodiment the back plate 80 is at approximately a 70° angle relative to the bottom plate 10. As shown in FIG. 4A, angling the back plate 80 in relation to the base plate 10 permits the person loading the newspaper to fit his arm into a space 82 in front of back plate 80, thus allowing the newspapers to be easily placed in alignment in the machine 200. Applicant has found that if the back plate 80 is at an angle less than 60° relative to the bottom plate 10, then the newspapers tend to rest in part on the back plate 80 when loaded into the machine instead of resting completely on the lower front portion of the transfer plate 30. If the angle is greater than 80°, it is difficult to place the newspapers in alignment in the machine 200. An angle between approximately 60° and 80° relative to the bottom plate 10 has bee found to be most effective for the back plate 80.

The door 100 is connected to the transfer plate 30 by connecting means. In the present embodiment, the connecting means are hinges 38 and lever arms 40. There is one lever arm 40 underneath each side of the transfer plate 30, as shown in FIG. 6. As shown in FIGS. 4 and 6, the hinges 38 are attached to the underside of the transfer plate 30. A first end of each of the lever arms 40 is connected to one of the hinges 38. A second end of each of lever arms 40 is connected to the door 100 as shown in FIG. 2. The door 100 has the handle 102 as previously described, and also a door hinge 104 as shown in FIGS. 4, 4A, 5 and 5A. The door hinge 104 connects the front wall 78 to the bottom of the door 100.

Attached to the inside of the front wall 78 is a means for adjusting the height of the slot 130 in the front of the machine 200. In the present embodiment, the adjustment means is an adjustment panel 120. The adjustment panel 120 is secured to the front wall 78 by a wing nut 122. By loosening the wing nut 122, the adjustment panel 120 may be raised or lowered to define the height of the slot 130, as described below. To secure the adjustment panel 120 at the desired height, the wing nut 122 is tightened. The adjustment panel 120 may be lowered so as to permit only a thin newspaper to be fed out of slot 130. Further, the adjustment panel 120 may be raised so as to permit a thick newspaper such as a Sunday newspaper to be fed out of slot 130.

The operation of the machine 200 of the present embodiment is as follows. The door 100 is secured to the coin mechanism 110 by the door lock 106. The door lock 106 is released only when the required coins are deposited in the coin mechanism 110. To obtain a newspaper from the machine, the purchaser first places the required coins in the coin mechanism 110.

Placing the appropriate coins in the coin mechanism 110 releases the door lock 106. When the door lock 106 is released, the door 100 may then be opened using the handle 102. Pulling the handle 102 forward and down as shown in FIGS. 2, 5 and 5A causes the transfer plate 30, which is connected to the door 100 through the hinges 38 and lever arms 40 as previously described, to slide forward out of the machine 200 through the slot 130 as shown in FIGS. 2, 5 and 5A. The lower front portion of the transfer plate 30 slides on the front two nylon ball bearings 20. The glide plate 32, which is attached to the transfer plate 30 as previously described, slides on the rear ball bearing 20. The transfer plate 30 remains horizontal as it slides in the machine during the vend operation because, as previously described, the glide plate 32 is at the same vertical level as the lower front portion of the transfer plate 30. In the present embodiment, the lip 50 of the transfer plate 30 does not come in contact with the ball bearings 20. The lever arms 40 pivot downwardly as the transfer plate 30 slides forward, as shown in FIGS. 5 and 5A.

While particular slide means such as nylon ball bearings have been described, other means may be used and are contemplated by the invention. Further, connecting means between the door 100 and transfer plate 30, other than hinges and lever arms, may be used and are contemplated by the invention.

When the transfer plate stop 34 comes in contact with the base plate stop 14, the door may not be opened any further by the purchaser. This prevents the transfer plate 30 from sliding completely out of the machine 200.

As the transfer plate 30 slides forward out of the machine 200 through the slot 130, the lip 50 of the transfer plate 30 pushes the bottom newspaper in the stack forward and thus out of the machine 200 through the slot 130 as shown in FIG. 5A. That newspaper 300 is then available to the purchaser as shown in FIGS. 2 and 5A.

The remaining newspapers in the stack in the machine 200 are prevented from exiting the machine through slot 130 because a bottom portion 124 of the adjustment panel 120 blocks all newspapers from exiting slot 130 except for the bottom newspaper in the stack as shown in FIG. 5A. As previously described, changing the position of the adjustment panel 120 varies the height of the slot 130 and thus the size of the newspaper which may be vended.

It is extremely difficult for the purchaser to remove any additional newspapers from the machine 200 when the door 100 is open. When the door 100 is open during the vend operation, the remaining newspapers in the machine 200 rest in part on the lip 50 of transfer plate 30 as shown in FIG. 5A. Since the lip 50 is at a higher level than the lower front portion of the transfer plate 30, as most easily seen in FIGS. 4, 5 and 7, the remaining newspapers in the machine 200 are at a higher level than the slot 130, therefore making it very difficult for the purchaser to reach into the machine through slot 130, past the bottom portion 124 of the adjustment panel 120, and then finally up to the next newspaper in the stack. As best seen in FIGS. 5 and 5A, the bottom portion 124 of the adjustment panel 120, which extends inwardly from the front wall 78, makes the slot 130 deeper than it normally would be without the inward extension of the bottom portion 124 of the adjustment panel 120, thus adding to the difficulty of reaching into the machine 200 through the slot 130. In the present embodiment, the bottom portion 124 of the adjusted panel 120 preferably extends inwardly one and ½ inches from the front wall 78.

After the purchaser removes the newspaper from the transfer plate 30 and releases the handle 102 of door 100, the door 100 is pulled closed by spring 12 and the transfer plate 30 slides back into the machine on the nylon ball bearings 20. As the lip 50 of the transfer plate 30 slides back in the machine underneath the bottom of the back plate 80, the remaining newspapers in the stack drop off the lip 50 of the transfer plate 30 onto the front section of the transfer plate 30 and are then ready for the next vend operation. The remaining newspapers in the stack slide easily off the lip 50 when the transfer plate 30 slides back into the machine because of the plastic strips 52 on the top of lip 50.

While particular attachment means such as welding, bolting or wingnuts have been described throughout the above description of one embodiment of the invention, other mechanical connections or fastening means may be used and are contemplated by the present invention.

Although the machine of the present invention has been described above in terms of newspaper vending, it is readily apparent that the machine could be used to vend items other than newspapers. Further, the machine of the present invention could be used to vend more than one item at a time if so desired, or to vend single items of different thicknesses, depending on the height of the lip 50 of the transfer plate 30 and the size of the slot 130.

Also, it will be understood that the invention contemplates other embodiments and variations within the scope of the following claims.

I claim:

1. A machine for vending a single item from a stack of items comprising:

a frame;

a slot in a front wall of said frame;

adjustment means for adjusting the height of said slot;

access means comprising a door with a handle mounted on said front wall of said frame for restricting access to said slot;

support means mounted within said frame;

slide means fixably mounted on said support means;

transfer means resting on said slide means generally in a fixed horizontal plane wherein a raised rear portion of said transfer means is at a level higher than a lower front portion of said transfer means, said door being connected to said frame below the plane of the transfer means by means of a hinged connection; and connecting means betweeen said access means and said transfer means whereby release of said access means by use of said activation means allows access to said slot and permits said transfer means to slide forward on said slide means, thus causing said raised rear portion of said transfer means to push an item out of said slot, said connecting means comprising a first hinge, a second hinge and a lever arm whereby said first hinge is attached to said transfer means, a first end of said lever arm is connected to said first hinge, said second hinge is attached to said door and a second end of said lever arm is connected to said second hinge wherein said first hinge, said second hinge and said lever arm are all located below the plane of the transfer means and above said hinged connection of said door to said frame.

2. The machine of claim 1 wherein said door cannot be opened until said activation means is activated.

3. The machine of claim 2 wherein said activation means comprises a coin mechanism mounted on said frame and operably connected to said door for receiving the purchase price of the item and releasing said door when the purchase price is received.

4. The machine of claim 1 wherein the activation means comprises a coin mechanism mounted on said frame and operably connected to said access means for receiving the purchase price of the item and releasing said access means when the purchase price is received.

5. The machine of claim 1 wherein said slide means comprises at least one ball bearing.

6. The machine of claim 1 wherein said raised rear portion of said transfer means is ½ inch higher than said lower front portion of said transfer means.

7. The machine of claim 1 wherein said adjustment means is mounted on the inside of said front wall and wherein a portion of said adjustment means closest to said slot extends inwardly from said front wall whereby the depth of said slot is increased.

8. The machine of claim 7 wherein the portion of said adjustment means closest to said slot extends inwardly one and ½ inches from said front wall.

9. The machine of claim 1 wherein said support means comprises a base plate mounted within said frame.

10. The machine of claim 9 wherein said slide means comprises at least one ball bearing.

11. The machine of claim 1 wherein said transfer means comprises a single transfer plate having a glide plate attached underneath said raised rear portion of said transfer plate whereby said glide plate rests on said slide means.

12. The machine of claim 11 wherein said glide plate is at the same vertical level as said lower front portion of said transfer plate.

13. The machine of claim 12 also having a back plate mounted within said frame whereby said back plate, said transfer plate, said front wall and a top wall of said machine define an interior space within said machine wherein items are stacked.

14. The machine of claim 13 wherein said back plate extends from said top wall to just above said raised rear portion of said transfer plate.

15. The machine of claim 14 wherein said back plate is mounted within said frame at an angle between 60° and 80° relative to said base plate whereby stacked items may be easily loaded into the machine from the top.

16. The machine of claim 2 wherein said door also has a clear window for showing a sample of the item available for vending from said machine.

17. The machine of claim 1 also having an opening in a side of said frame for determining whether any items remain in said machine for vending.

18. A machine for vending a single item comprising:

a frame;

loading means for loading a stack of items into said machine;

a slot in a front wall of said frame;

an adjustment panel mounted on the inside of said front wall for adjusting the height of said slot;

a door with a handle mounted on said front wall restricting access to said slot unless said door is opened;

a coin mechanism mounted on said frame and operably connected to said door whereby said door cannot be opened unless said coin mechanism is activated;

a base plate fixably mounted within said frame;

ball bearings mounted on top of said base plate;

a transfer plate resting generally in a fixed horizontal plane on said ball bearings wherein a raised rear portion of said transfer plate is at a level higher than a lower front portion of said transfer plate and wherein a glide plate is mounted beneath said raised rear portion of said transfer plate whereby said glide plate is generally at the same vertical level as said lower front portion of said transfer plate and is in contact with at least one of said ball bearings, said door being mounted on said front wall below the plane of the transfer plate by means of a hinged connection;

a back plate mounted within a rear part of said frame and defining a back portion of an interior space in said machine wherein the stack of items may be loaded and whereby said back plate extends from a top wall of said machine to just above said raised rear portion of said transfer plate; and connecting means between said transfer plate and said door whereby opening said door, after activating said coin mechanism, causes said transfer plate and said glide plate to slide forward on said ball bearings whereby said raised rear portion of said transfer plate pushes an item out of said slot, said connecting means comprising a first hinge, a second hinge and a lever arm whereby said first hinge is attached to said transfer plate, a first end of said lever arm is connected to said first hinge, said second hinge is attached to said door and a second end of said lever arm is connected to said second hinge, wherein said first hinge, said second hinge and said lever arm are all located below the plane of the transfer plate and above said hinged connection of said door to said front wall.

19. The machine of claim 18 wherein said back plate is mounted within said frame at an angle between 60° and 80° relative to said base plate whereby stacked items may be easily loaded into the machine from the top.

20. The machine of claim 18 wherein said raised rear portion of said transfer plate is ½ inch higher than said lower front portion of said transfer plate.

21. The machine of claim 18 having three of said ball bearings mounted on top of said base plate.

22. The machine of claim 18 wherein said loading means comprises a top cover on said machine.

23. The machine of claim 18 wherein a portion of said adjustment panel closest to said slot extends inwardly from said front wall one and ½ inches.

* * * * *